US008620191B2

(12) United States Patent
Okazaki et al.

(10) Patent No.: US 8,620,191 B2
(45) Date of Patent: Dec. 31, 2013

(54) DEVELOPING DEVICE AND IMAGE FORMATION APPARATUS

(75) Inventors: Futoshi Okazaki, Toyokawa (JP); Hirofumi Ishida, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 370 days.

(21) Appl. No.: 13/164,895

(22) Filed: Jun. 21, 2011

(65) Prior Publication Data

US 2011/0311279 A1 Dec. 22, 2011

(30) Foreign Application Priority Data

Jun. 21, 2010 (JP) ..... 2010-140708

(51) Int. Cl.
*G03G 15/08* (2006.01)

(52) U.S. Cl.
USPC ..... 399/254

(58) Field of Classification Search
USPC ..... 399/254–257
See application file for complete search history.

(56) References Cited

U.S. PATENT DOCUMENTS 5,963,766 A * 10/1999 Okuno et al. ..... 399/256
2007/0231014 A1* 10/2007 Noguchi et al. ..... 399/254
2008/0260430 A1* 10/2008 Sakamoto et al. ..... 399/254
2009/0074468 A1* 3/2009 Iwata et al. ..... 399/254
2009/0092419 A1* 4/2009 Iwata et al. ..... 399/254
2009/0214266 A1* 8/2009 Kato et al. ..... 399/254

FOREIGN PATENT DOCUMENTS

JP 2005-077976 A 3/2005
JP 2005-338542 A 12/2005
JP 2006-058609 A 3/2006
JP 2007-334101 A 12/2007
JP 2008-250290 A 10/2008
JP 2009-092911 A 4/2009

* cited by examiner

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A developing device comprising: a first transport member disposed in a first transport passage and configured to rotate and thereby transport developer; a second transport member disposed in a second transport passage and configured to rotate and thereby transport the developer; and a developer carrier configured to carry the developer supplied from the first transport passage, wherein the second transport passage is composed of an upstream section and a downstream section, the second transport passage communicates with the first transport passage via a first communication passage and a second communication passage, the upstream section is configured to receive refill toner, and V1<V2<V3, where V1 denotes an average transport speed of the first transport member, V2 denotes an average transport speed of an upstream section of the second transport member, and V3 denotes an average transport speed of a downstream section of the second transport member.

11 Claims, 7 Drawing Sheets

| | Relationship among transport speeds | Stability | Feeding performance | Fogging level |
|---|---|---|---|---|
| Practical example 1 | V1<V2<V3 | ○ | ○ | ○ |
| Comparative example 1 | V1=V2=V3 | △ | × | △ |
| Comparative example 2 | V1>V2=V3 | × | × | × |
| Comparative example 3 | V1<V2=V3 | ○ | ○ | × |

DEVELOPING DEVICE AND IMAGE FORMATION APPARATUS

This application is based on application No. 2010-140708 filed in Japan, the contents of which are hereby incorporated by reference.

BACKGROUND OF THE INVENTION (1) Field of the Invention

The present invention relates to a developing device and an image formation apparatus provided with the same.

(2) Description of the Related Art

Image formation apparatuses, which include copiers and printers, are provided with a developing device that develops, by using developer, an electrostatic latent image formed on an image carrier such as a photosensitive drum.

A developing device usually includes a developing roller for carrying developer, and a circulation passage for circulating the developer with the aid of, for example, a transport screw provided with a spiral blade.

The developing roller faces the photosensitive drum, and develops an electrostatic latent image formed on the photosensitive drum, by using developer carried thereby and toner.

In many cases, the circulation passage for circulating developer has the following structure. The circulation passage consists of first and second transport passages and first and second communication passages. The second transport passage transports developer in the opposite direction as the first transport passage. The first communication passage connects a downstream section of the first transport passage with an upstream section of the second transport passage. The second communication passage connects a downstream section of the second transport passage with an upstream section of the first transport passage. Developer thus circulates via the circulation passage, and is supplied to the developing roller which is disposed along the first transport passage.

Each of the first and second transport passages is provided with a transport screw for transporting developer. However, neither of the first and second communication passages is provided with any transport screw. Developer circulates due to the flow force caused by the transport screws provided in the first and second transport passages.

With such a structure for circulation, developer often accumulates in the communication passages, which makes the surface of the developer uneven. That is, in each of the first and second transport passages, the surface level (i.e. height) of the developer is higher in its downstream section than in its upstream section.

Such an uneven surface level of the developer leads to an imbalance between the amounts of the developer at both edges of the developing roller in the direction of the axis thereof. This is problematic because, for example, there is a risk of degradation in the developing performance at one edge of the developing roller that is provided with a smaller amount of developer than the other edge.

Japanese Patent Application Publication No. 2007-334101 discloses a structure for making the surface level of developer even. According to Japanese Patent Application Publication No. 2007-334101, in both the first and second developer transport passages horizontally arranged next to each other, the pitch of the spiral blade of the transport screw is increased only near the downstream edge, so that the speed of transporting the developer is higher near the downstream edge than in the rest of the transport passage.

With this structure, the speed of transporting the developer is increased near the downstream edges of the transport screws. That is, the moving speed of the developer increases immediately before it enters the communication passages, and this flow force allows the developer to easily pass through the communication passages. This prevents the developer from accumulating in the communication passages.

In the meanwhile, there are great demands for downsizing image formation apparatuses, since image formation apparatuses are installed in offices and the likes. One possible means for downsizing an image formation apparatus is to downsize its developing device which serves as the main part of the image formation apparatus.

Usually, developing devices have an elongated shape along the main scanning direction (i.e. the direction that is orthogonal to the transport direction of printer sheets). Thus, to downsize a developing device, the length of the housing and/or the width of the housing can be shortened.

However, it is almost always necessary not to change the functionality related to image formation, even in the case of downsizing the image formation apparatus. The functionality means, for example, the system speed and the available sheet sizes. To meet such a condition, it is impossible to shorten the length of the housing. A possible way is to furthermore shorten the width of the housing even though it originally has an elongated shape.

Shortening the width of the housing means decreasing the capacity of the housing, and thus it is necessary to decrease the amount of the developer to be housed therein.

If the system speed is the same as before the downsizing, it is necessary to provide the photosensitive drum with the same amount of developer per unit time in order to keep the developing performance at the same level as before the downsizing.

One possible means for providing the photosensitive drum with the same amount of developer per unit time with a smaller total amount of developer in the housing is to increase the circulation speed of the developer in the housing and thereby provide the developing roller with an increased amount of developer per unit time. One possible means for increasing the circulation speed of the developer is to increase the rotation speed of the transport screw.

However, the flow of the developer becomes more turbulent as the rotation speed of the transport screw increases, and the transport amount per unit of the developer does not change linearly according to the change of the rotation speed of the transport screw. Thus, it is difficult to increase the circulation speed of the developer simply by increasing the rotation speed of the transport screw.

Furthermore, it should be noted that toner consumed in the developing operation is repeatedly refilled, and the amount of developer in the housing repeatedly increases and decreases due to the time lag between the consumption and the refilling.

Such changes of the amount of developer in the housing lead to changes of the amount of developer to be supplied to the developing roller. If the total amount of developer in the housing is relatively large, the change of the amount does not affect the amount of developer to be supplied to the developing roller very much, since the ratio of the change to the total amount is small.

However, in the case where the total amount of the developer is small due to the downsizing, if the amount of the developer changes by the same amount as before the downsizing, the ratio of the change to the total amount is relatively large. As a result, the developing roller tends to be short of developer when the amount of developer is decreased. The shortage of developer supplied to the developing roller leads to degradation of the developing performance such as lowering of density in high-density images.

Moreover, refilled toner should be stirred and charged while being transported. If the rotation speed of the transport screw is increased, the moving speed of developer is increased accordingly, and developer tends to be supplied to the developing roller before the charge amount reaches a required level. Shortage of the charge leads to degradation of the developing performance, such as causing fogging in blank space on printing sheets.

With the developing device disclosed in the Japanese Patent Application Publication mentioned above, it can be assumed that the surface level of the developer decreases overall in both the first and second transport passages when the total amount of developer is decreased. Here, if the amount of developer is changed under the condition where the total amount of developer is small, the ratio of the change to the total amount is relatively large. As a result, the developing roller tends to be short of developer. Also, when the transport speed of the developer is increased, the developing roller tends to be supplied with toner that is not charged enough. This is problematic.

Such a problem often arises particularly when a trickle developing method is adopted. In a trickle developing method, developer containing new carrier is refilled from an inlet of the housing bit by bit, and a portion of an excessive developer generated due to the refilling is discharged from an outlet of the housing as the developer overflows. Therefore, in developing devices in which a trickle developing method is adopted, the total amount of the developer in the housing is liable to change.

SUMMARY OF THE INVENTION

One aim of the present invention is to provide a developing device and an image formation apparatus that realize downsizing of the apparatus and prevention of degradation of developing performance at the same time.

The aim 1s achieved by a developing device comprising: a first transport passage; a first transport member disposed in the first transport passage and configured to rotate and thereby transport developer along the first transport passage in a first transport direction, the developer containing toner; a second transport passage; a second transport member disposed in the second transport passage and configured to rotate and thereby transport the developer along the second transport passage in a second transport direction; and a developer carrier disposed along the first transport passage and configured to carry the developer supplied from the first transport passage, wherein the second transport passage is composed of an upstream section and a downstream section with respect to the second transport direction, the second transport passage communicates with the first transport passage via a first communication passage and a second communication passage, the first communication passage being connected to the upstream section, the second communication passage being connected to the downstream section, and the first transport passage, the first communication passage, the second transport passage, and the second communication passage constituting a circulation passage for circulating the developer, the upstream section is configured to receive refill toner, and $V1<V2<V3$, where V1 denotes an average transport speed of the first transport member, V2 denotes an average transport speed of a section of the second transport member within the upstream section of the second transport passage, and V3 denotes an average transport speed of a section of the second transport member within the downstream section of the second transport passage.

The aim 1s also achieved by an image forming apparatus having the developing device defined above.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes embodiments of a developing device and an image formation apparatus that pertain to the present invention, based on an example case in which they are adopted in a tandem color digital printer (hereinafter simply referred to as "printer").

[Embodiment 1]

<Overall Structure of Printer>

Figure 1:
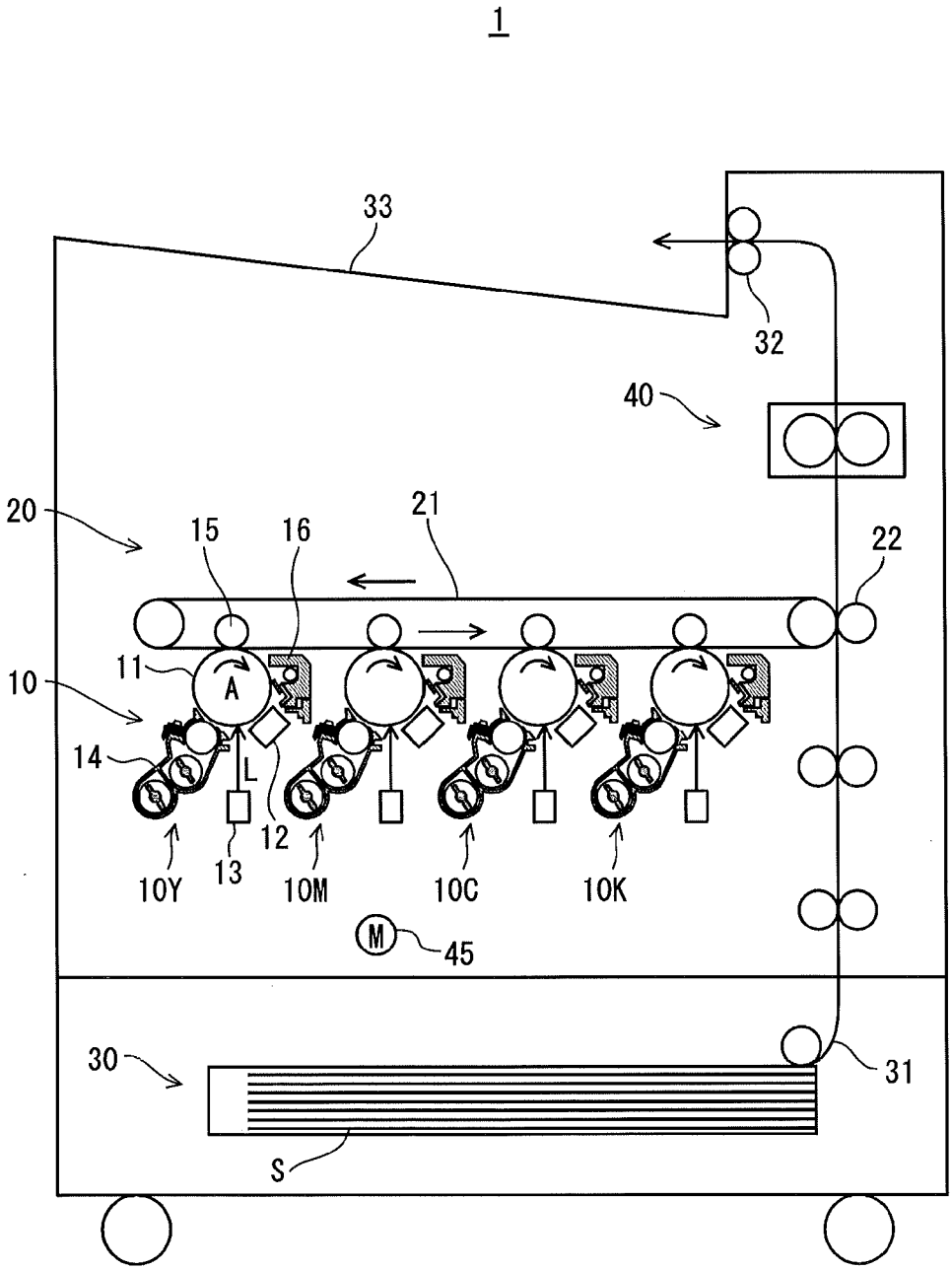
FIG. 1 is a schematic diagram showing an overall structure of a printer pertaining to Embodiment 1.

FIG. 1 is a schematic diagram showing an overall structure of a printer 1 pertaining to Embodiment 1.

As shown in the drawing, the printer 1 forms images by a well-known electrophotographic method. The printer 1 includes, an image processing unit 10, an intermediate transfer unit 20 provided with an intermediate transfer belt 21, a paper feed unit 30, and a fusing unit 40. The printer 1 is capable of performing color printing based on job requests from an external terminal device (not depicted) received via a network (such as a LAN).

The image processing unit 10 includes image creating units 10Y, 10M, 10C, and 10K corresponding respectively to colors of yellow (Y), magenta (M), cyan (C), and black (K). The image creating unit 10Y includes a photosensitive drum 11, and a charger 12, an exposing unit 13, a developing unit 14, a first transfer roller 15, and a cleaner 16, which are arranged around the photosensitive drum 11.

The charger 12 electrically charges the circumferential surface of the photosensitive drum 11 which rotates in the direction indicated by the arrow A.

The exposing unit 13 forms an electrostatic latent image on the photosensitive drum 11 by emitting a laser beam L to expose-scan the charged photosensitive drum 11.

The developing unit 14, using the trickle developing method, is provided with a two-component developer containing carrier and toner, and develops the electrostatic latent image on the photosensitive drum 11 by using the toner. This allows a yellow (color Y) toner image to be formed on the photosensitive drum 11.

The first transfer roller 15 causes the yellow toner image to be transferred from the photosensitive drum 11 onto the intermediate transfer belt 21 by the electrostatic action. The cleaner 16 cleans the toner that has remained on the photosensitive drum 11Y after the transfer. Each of the other image creating units 10M through 10K has the same structure as the image creating unit 10Y, and reference signs of the components thereof are omitted in FIG. 1.

The intermediate transfer belt 21 is suspended with tension between a drive roller and a passive roller, and is caused to move cyclically in the direction indicated by the arrows shown in FIG. 1 by the drive force generated by the drive roller.

Toner images of colors respectively corresponding to the image creating units 10Y through 10K are created on the photosensitive drum 11, and the created toner images are transferred onto the intermediate transfer belt 21. In this image creation of colors Y through K, the toner images of these colors are transferred at timings that are shifted in order from the upstream side to the downstream side so that they are layered on the intermediate transfer belt 21 at the same position.

The feeding unit 30 feeds sheets S one by one from the paper feed cassette at timings corresponding to the image creations so that the sheets S are transported in the transport passage 31 to the second transfer roller 22.

The toner images of the respective colors formed on the intermediate transfer belt 21 are transferred onto a sheet S at the same time by the electrostatic action of the second transfer roller 22 as the second transfer when the sheet S passes through between the second transfer roller 22 and the intermediate transfer belt 21.

The sheet S, on which the toner images of the respective colors have been secondarily transferred, is transported to the fixing unit 40, in which it is heated and receives a pressure. The toner on the surface of the sheet S thus melts to be fixed to the surface, and then the sheet S is ejected onto a catch tray 33 by a paper ejecting roller 32.

A driving motor 45, which is provided below the image creating unit 10M, is used as a drive source for driving each of the rollers included in the printer 1, namely the photosensitive drum 11, the intermediate transfer belt 21, the first transfer roller 15, etc. These rollers are driven to rotate by drive force transmitted from the driving motor 45 via a drive transmission mechanism, which is not depicted.

<Structure of Developing Unit>

Figure 2:
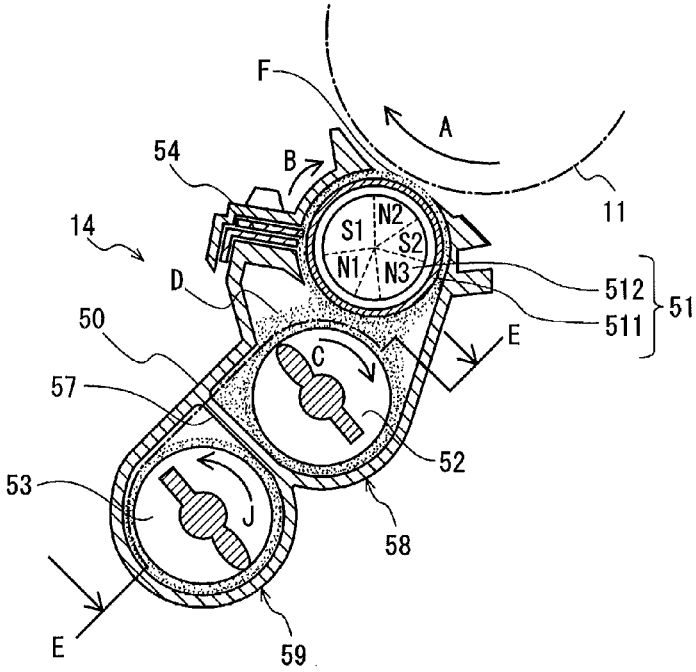
FIG. 2 is a cross-sectional view showing an example structure of a developing unit provided in the printer.

FIG. 2 is a cross-sectional view showing an example structure of the developing unit 14.

As shown in FIG. 2, the developing unit 14 includes a housing 50, a developing roller 51, a feed screw 52, a stirring screw 53, a restriction member 54, and so on. Each of the components 50-54 extends along the direction in which the axis of the developing roller 51 extends (which is equivalent to the vertical direction of the drawing sheet, hereinafter referred to as "the axis direction"). As explained above, the developing unit 14 is provided for each of the colors Y through K and the developing units have the same structure. Thus, only the developing unit 14 for the color K is described below and description of the developing units 14 for the other colors are omitted.

The housing 50 contains two-component developer D for the color K, which contains carrier and toner. The internal space of the housing 50 is divided by a partition (i.e. separator) 57 into a feed chamber (i.e. the upper chamber) 58 and a stirring chamber (i.e. the lower chamber) 59. The feed chamber 58 houses the developing roller 51 and the feed screw 52. The stirring chamber 59 houses the stirring screw 53.

The developing roller 51 is provided in the feed chamber 58 so as to face the outer circumferential surface of the photosensitive drum 11 through an opening of the feed chamber 58. The developing roller 51 includes a cylindrical developing sleeve 511 and a magnet roller 512 that is inserted in the developing sleeve 511 along the axis direction.

The magnet roller 512 has areas on which magnetic poles, N1, S1, N2, S2 and N3 for example, are formed. These magnetic areas are sequentially arranged on the circumferential surface of the magnet roller 512. The edges of the magnet roller 512 in the axis direction are fixed to the housing 50 so that the magnet roller 512 is prohibited to rotate. The magnetic areas extend along the axis direction.

The developing sleeve 511 is provided such that part thereof is exposed from the opening of the housing 50 so as to face the photosensitive drum 11 through the opening, and is held in the housing 50 so as to be rotatable in the direction indicated by the arrow B. The developing sleeve 511 rotates around the magnet roller 512 which is static, while holding (i.e. carrying) the developer D on the surface thereof by magnetic force generated by the magnet roller 512.

The feed screw 52 is provided in the feed chamber 58 so as to face the photosensitive drum 11 across the developing roller 51 and is rotatably supported by the housing 50 so as to be parallel to the axis direction. The feed screw 52 rotates in the direction indicated by the arrow C, thereby carrying the developer D in the feed chamber 58 and providing the developing roller 51 with the developer D.

The stirring screw 53 is provided in the stirring chamber 59, and is rotatably supported by the housing 50 so as to be parallel to the axis direction. The stirring screw 53 rotates in the direction indicated by the arrow J, thereby carrying the developer D in the stirring chamber 59 in the opposite direction as the feeding direction of the feed screw 52 while stirring the developer D.

The restriction member 54 is provided such that there is a gap between the tip thereof and the surface of the developing roller 51. The restriction member 54 restricts the amount of the developer D that passes through the gap so that the amount of developer on the surface of the developing roller 51 is appropriate at a developing position F.

Figure 3:
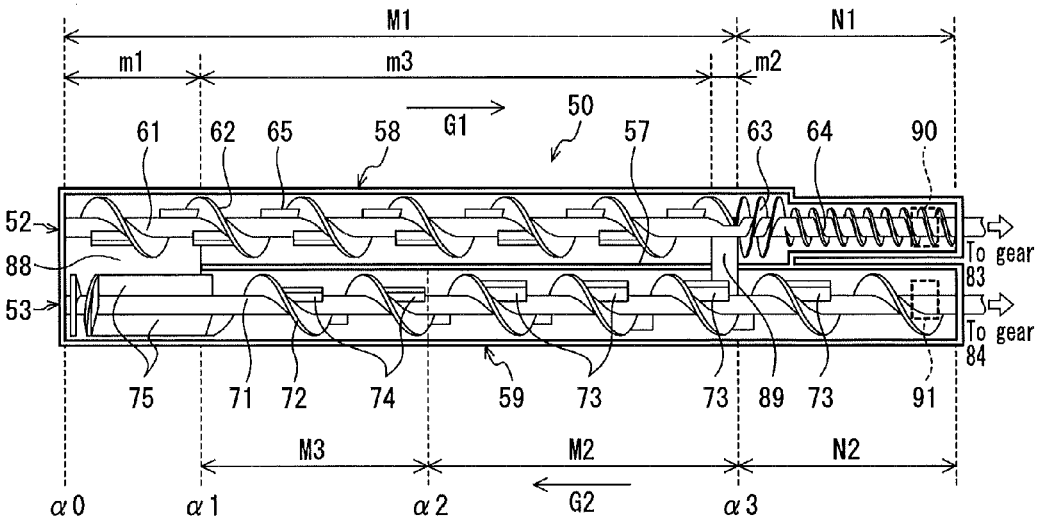
FIG. 3 is a cross-sectional view of the developing unit when viewed in the direction indicated by the arrows in FIG. 2, which point to the line E-E in FIG. 2.
Figure 4:
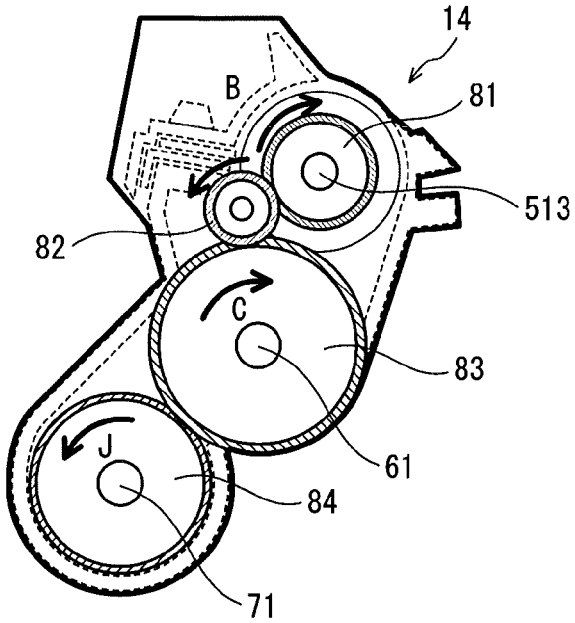
FIG. 4 shows an example structure of a mechanism for transmitting driving force to a feed screw and a stirring screw provided in the developing unit.

FIG. 3 is a cross-sectional view of the developing unit along the line E-E in FIG. 2 when viewed from the direction indicated by the arrows in FIG. 2. FIG. 4 shows an example structure of the mechanism for transmitting driving force to the feed screw 52 and the stirring screw 53. Note that the developer D is not depicted in FIG. 3.

As shown in FIG. 3, each of the feed chamber 58 and the stirring chamber 59 provided in the housing 50 has a cylindrical shape and extends along the axis direction. The feed chamber 58 and the stirring chamber 59 are separated by the partition 57, but they communicate with each other via an opening 88 provided near one edge (the left edge in the drawing) and an opening 89 provided near the other edge (the right edge in the drawing).

In the following description, in regard to both the feed chamber 58 and the stirring chamber 59, the area in which the opening 88 is provided is referred to as "the area m1", the area in which the opening 89 is provided is referred to as "the area m2", and the area sandwiched between the areas m1 and m2 is referred to as "the area m3". These areas are arranged along the axis direction. The area composed of the areas m1, m2 and m3 is referred to as "the area M1". In regard to the feed chamber 58, the area other than the area M1 is referred to as "the area N1". In regard to the stirring chamber 59, the area other than the area M1 is referred to as "the area N2" These areas are also arranged along the axis direction.

Furthermore, the position at one end of the area M1 is referred to as "the reference position α0", and the position at the other end of the area M1 is referred to as "the reference position α3". The position on the border between the areas m1 and m3 is referred to as "the position α1". The middle point between the position α0 and the position α3 is referred to as "the position α2". The area between the position α2 and the position α3 is referred to as "the area M2", and the area between the position α1 and the position α2 is referred to as "the area M3".

Note that the area M1 of the feed chamber 58 and the area M1 of the stirring chamber 59 constitute the circulation passage of the developer D as described below, the area N1 of the feed chamber 58 corresponds to a discharge passage of the developer D used in the trickle developing method, and the area N2 of the stirring chamber 59 corresponds to a feed passage used for refilling the developer D.

<Feed Screw 52>

The feed screw 52 has a rotation shaft 61, spiral blades 62, 63 and 64, and a plurality of paddles 65. The edges of the rotation shaft 61 in the axis direction are rotatably supported on the edges of the feed chamber 58 via bearings or the likes (not depicted) provided on the side walls of the edges of the feed chamber 58. As seen from the drawing, the right edge of the rotation shaft 61 penetrates the side wall and protrudes outward. A gear 83 (see FIG. 4) is attached to the protrusion, and the rotation shaft 61 is driven to rotate in the direction indicated by the arrow C (see FIG. 2) by the rotational drive force from the gear 83.

The spiral blades 62-64 are spirally provided on the outer circumferential surface of the rotation shaft 61. The spiral blade 62 is provided in the area M1 and the spiral blades 63 and 64 are provided in the area N1.

The spiral blades 62 and 64 are configured to transport the developer D contained in the feed chamber 58 in the direction indicated by the arrow G1 as the rotation shaft 61 rotates. The spiral blade 63 is configured to transport the developer D in the opposite direction as the direction indicated by the arrow G1.

The winding direction of the spiral blade 63 is opposite from the winding direction of the spiral blade 62. The spiral blade 63 provides transporting force in the opposite direction to the developer D transported by the spiral blade 62 in the direction indicated by the arrow G1. The amount of developer transported by the spiral blade 63 is determined by the difference between the transporting force generated by the spiral blade 62 and the opposite transporting force generated by the spiral blade 63. In this embodiment, only a small portion of the developer D transported by the spiral blade 62 is further transported by the spiral blade 63 toward the spiral blade 64.

The spiral blade 64 transports a portion of the developer D in the area N1, which has passed by the spiral blade 63, in the direction indicated by the arrow G1, while discharging a portion of the developer D provided from the developing unit 14 via the outlet 90 (depicted in dashed line) that is provided in the area N1, near the edge of the feed chamber 58. The discharged portion of the developer D is collected in a collection tank or the like (not depicted).

Each of the paddles 65 is composed of a plate, which protrudes perpendicularly from the outer circumferential surface of the rotation shaft 61 and has a certain length along the axis direction. Each paddle 65 is provided between the sections of the spiral blade 62 where the blades are provided, and rotates about the shaft 61 while scooping the developer D that is being transported in the axis direction. Thus, the paddles 65 have a function to restrict the amount of the developer D to be transported by the spiral blade 62.

More specifically, some of the particles of the toner and carrier of the developer D, which have passed by the paddles 65 without being obstructed by the rotating paddles, are transported along the axis direction, while other particles of the developer D, which have been scooped by the paddles 65, are stirred along the rotating direction of the paddles 65 and are not given the flow force in the axis direction caused by the spiral blade 62.

That is, due to the paddles 65, there are (i) particles that are given a flow force in the axis direction caused by the spiral blade 62 and (ii) particles that are not given such a flow force. The developer D containing such particles is transported. When the ratio of the particles not given the flow force increases in the developer D, the average transport speed of the developer D is reduced accordingly.

If the height of the paddles 65 (i.e. the length of the perpendicular protrusion from the outer circumferential surface of the rotation shaft 61) is increased, the amount of particles scooped by the paddles 65 increases, and thus the transport speed is reduced more. Similarly, the number of the paddles and the length thereof in the axis direction also affect the reduction effect.

In this embodiment, the paddles 65 have the same size, and two paddles are provided in one pitch of the spiral blade 62. However, this is not essential. The number and size of the paddles 65 are determined appropriately in relation to the transport speed of the developer D in the stirring chamber 59.

<Stirring Screw 53>

The stirring screw 53 includes a rotation shaft 71, a spiral blade 72 and paddles 73, 74 and 75 each having a different size.

The edges of the rotation shaft 71 in the axis direction are rotatably supported on the edges of the stirring chamber 59 via bearings or the likes (not depicted) provided on the side walls of the edges of the stirring chamber 59. As seen from the drawing, the right edge of the rotation shaft 71 penetrates the side wall and protrudes outward. A gear 84 (see FIG. 4) is attached to the protrusion, and the rotation shaft 71 is driven to rotate in the direction indicated by the arrow J (see FIG. 2) by the rotational drive force from the gear 84.

The spiral blade 72 is spirally provided on the outer circumferential surface of the rotation shaft 71. The spiral blade 72 is provided in the areas except for the area m1, namely in the areas M3, M2 and N2. As the rotation shaft 71 rotates, the spiral blade 72 transports the developer D in the stirring chamber 59 in the direction indicated by the arrow G2 (which is opposite to the direction indicated by the arrow G1). Note that the spiral blade 72 and the spiral blade 62 have the same pitch and the same outside diameter.

The paddles 73-75 are each provided in a plurality.

Each of the paddles 73 is provided between the blade sections of the spiral blade 72 at intervals, from the outer circumferential surface of the rotation shaft 71 in the areas M2 and N2. Each of the paddles 74 is provided between the blade sections of the spiral blade 72 at intervals, from the outer circumferential surface of the rotation shaft 71 in the areas M3.

The paddles 73 and the paddles 74 have the same length along the axis direction. Also, the same number of the paddles 73 and the paddles 74 are provided in the unit length of the rotation shaft 71. Meanwhile, the height of the paddles 74 provided in the area M3 is lower than the height of the paddles 73 provided in the area M2. That is, H2<H1 is satisfied, where H1 denotes the height of the paddles 73 and H2 denotes the height of the paddles 74.

Both in the areas M2 and M3, the developer D is transported by the spiral blade 72 with the constant pitch, and the heights of the paddles satisfy H2<H1. Thus, the transport speed of the developer D is greater in the area M3 in which the paddles 74 are provided than in the area M2 in which the paddles 73 are provided.

The pair of paddles 75 protrude in opposite directions, from the outer circumferential surface of the rotation shaft 71 in the area m1 (which faces the opening 88). The height, H3 (>H1), of each of the paddles 75 is the same as the height of the spiral blade 72 (measured from the outer circumferential surface of the rotation shaft 71, in the direction that is perpendicular to the axis).

Each paddle 75 is configured to transport the developer D to the feed chamber 58 via the opening 88 by scooping the developer D in the stirring chamber 59, which has been transported to the area m1 by the spiral blade 72 rotated by the rotation shaft 71. The widths, in the axis direction, of the paddles 75 facing the opening 88 are not limited to any value. It is preferable, however, that the paddles 75 transport much of the scooped portion of the developer D to the opening 88. In this regard, it is preferable that the widths of the paddles 75 in the axis direction are the same as the width of the opening 88 in the axis direction.

<Transmission Mechanism for Each Screw>

The transmission mechanism for giving a rotational drive force to the feed screw 52 and the stirring screw 53 includes gears 81-84 and so on as shown in FIG. 4.

The gear 81 is attached to one end of the rotation shaft 513 of the developing roller 51 (which is the same as the rotation shaft of the developing sleeve 511). The gear 81 engages with the gear (not depicted) of the transmission mechanism of the apparatus when the developing unit 14 is coupled to the apparatus. The drive force from the driving motor 45 is transmitted via the gear. Thus, the gear 81 rotates in the direction indicated by the arrow B, and the developing sleeve 511 rotates in the same direction as the gear 81 rotates.

The gear 83 is attached to the rotation shaft 61 of the feed screw 52, and engages with the gear 81 via the idle gear 82. The gear 84 is attached to the rotation shaft 71 of the stirring screw 53, and engages with the gear 83.

The rotational drive force from the driving motor 45 is transmitted from the gear 81 to the gear 83 and the gear 84 in this order via the idle gear 82. Thus, the gear 83 rotates in the direction indicated by the arrow C shown in the drawing, and the gear 84 rotates in the direction indicated by the arrow J in the drawing. As a result, the feed screw 52 is driven to rotate in the direction indicated by the arrow C, and the stirring screw 53 is driven to rotate in the direction indicated by the arrow J.

In this embodiment, the number of teeth of the gear 84 is less than the gear 83 so that the rotation number of the stirring screw 53 per unit time is greater than the feed screw 52. For example, the rotation speed of the stirring screw 53 is determined to be within the rage from 1.1 to 1.3 times the rotation speed of the feed screw 52. The reason for differentiating the rotation speeds of the feed screw 52 and the stirring screw 53 will be described later.

<Flow of Developer>

Figure 5:
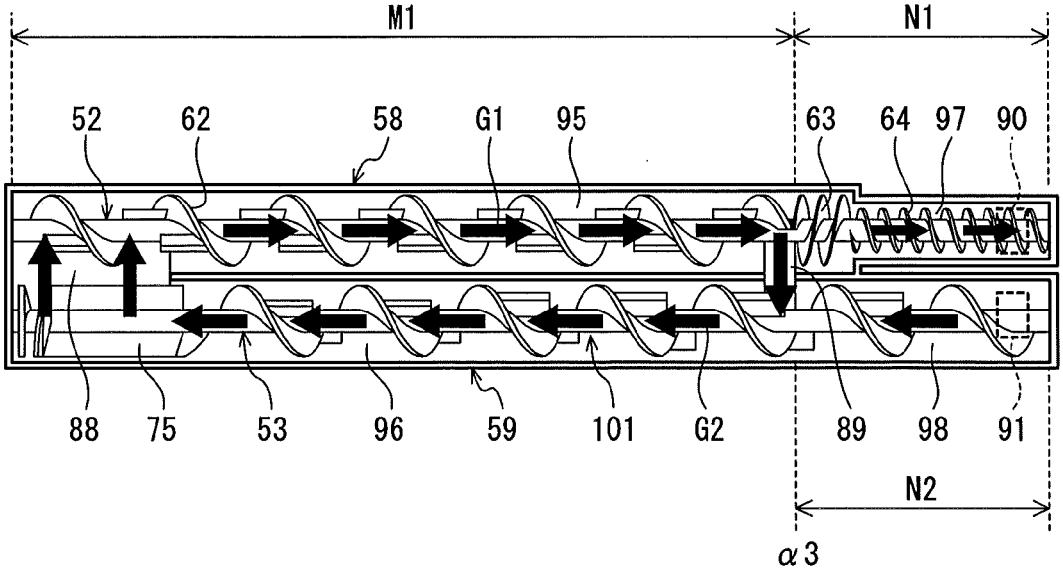
FIG. 5 schematically shows transportation of developer in the developing unit.
Figure 6:
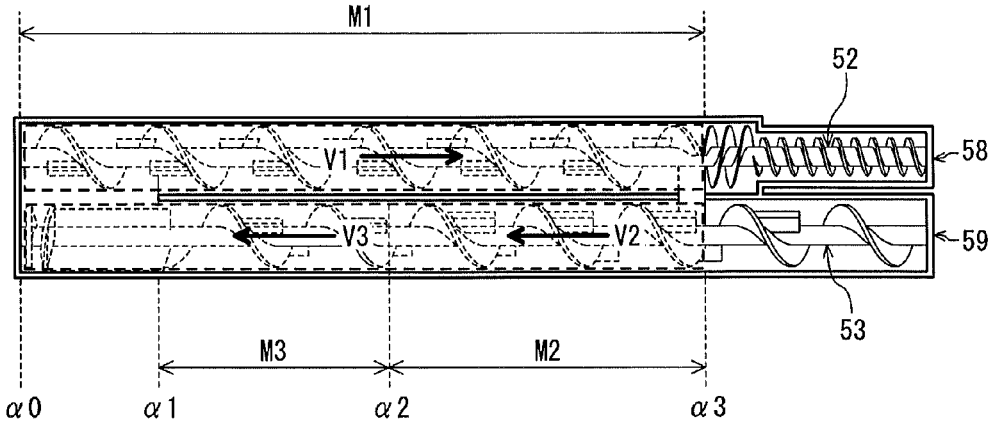
FIG. 6 shows average transport speeds of developer in three areas on the circulation passage of the developer.

The developer D in the housing 50 is transported as shown in FIG. 5 as the developing roller 51, the feed screw 52 and the stirring screw 53 rotate.

FIG. 5 schematically shows the transportation directions of the developer D with arrows.

As shown in the drawing, the developer D in the feed chamber 58 is transported in the area M1 by the spiral blade 62 of the feed screw 52 toward the right (i.e. in the direction indicated by the arrow G1), and near the downstream edge of the area M1, branches off into a flow toward the stirring chamber 59 via the opening 89 and a flow toward the area N1.

The entrance of the area N1 is provided with the spiral blade 63 that is wound in the opposite direction. Thus, most of the developer D is prevented from passing by the spiral blade 63 and entering into the area N1, and is pushed back, and is transported to the stirring chamber 59 via the opening 89. Only a small portion of the developer D is transported to the spiral blade 64, passing by the spiral blade 63. A portion of the developer D, which has passed by the spiral blade 63 and has been transported to the spiral blade 64, is transported by the spiral blade 64 through the area N1 (i.e. the discharge passage 97 for the developer), and is then discharged from the housing 50 via the outlet 90.

A portion of the developer D transported to the stirring chamber 59 via the opening 89 is transported by the stirring screw 53 in the area M1 toward the left (i.e. in the direction indicated by the arrow G2). Then, the portion is scooped by the paddles 75 at the opening 88 near the downstream edge of the area M1 and is transported to the feed chamber 58 via the opening 88. The portion of the developer D transported to the feed chamber 58 is transported by the feed screw 52 toward the right in the drawing (i.e. in the direction indicated by the arrow G1).

In the area M, the downstream section of the feed chamber 58 and the upstream section of the stirring chamber 59 communicate with each other via the opening 89, and the downstream section of the stirring chamber 59 and the upstream section of the feed chamber 58 communicate with each other via the opening 88. Thus, as described above, the area M1 in the feed chamber 58 (i.e. the first transport passage 95), where the developer D is transported by the feed screw 52, and the area M1 in the stirring chamber 59 (i.e. the second transport passage 96), where the developer D is transported by the stirring screw 53, communicate with each other via the openings 88 and 89 (i.e. the first and the second communication passages). This forms the circulation passage 101 for the developer D in the feed chamber 58 and the stirring chamber 59. The developer D circulates via this circulation passage 101.

While the developer D is being transported in the area M1 of the feed chamber 58 in the circulation passage 101, a portion of the developer D is provided to the developing roller 51.

Specifically, while being transported within the area M1 in the feed chamber 58, a portion of the developer D is carried by the circumferential surface of the developing sleeve 511, due to magnetic force caused by the magnetic pole N1 ("catching pole") of the magnet roller 512, which is shown in FIG. 2. The amount of the portion of the developer D which is carried on the circumferential surface of the developing sleeve 511 is restricted when the portion passes through the gap between the restriction member 54 and the developing sleeve 511 due to the rotation of the developing sleeve 511. Thus, a given amount of the developer D passes by the magnetic pole S1, and is provided to the developing position F which faces the photosensitive drum 11.

The developer D transported to the developing position F forms a magnetic brush due to the magnetic pole N2, which contributes to development of the electrostatic latent image on the photosensitive drum 11. After the development, the developer D, which has passed through the developing position F and the magnetic pole S2, is relieved from the magnetic force of the magnet roller 512 when passing by the magnetic pole N3, and is collected by the feed screw 52, and then returns to the circulation passage 101.

<Refilling of Developer>

As shown in FIG. 5, the area N2 in the stirring chamber 59, which is located upstream from the area M1, forms a feed passage 98 used for refilling the developer D.

In this embodiment, a hopper (not depicted) and a density sensor (not depicted) are provided separately from the developing unit 14. The hopper separately houses carrier and toner which constitute refill developer. The density sensor detects the density of the developer D in the housing 50. The refill carrier and toner is provided from the hopper to the feed passage 98 of the stirring chamber 59 via the inlet 91 (depicted in dashed line).

Specifically, a certain amount of carrier is supplied per unit time (e.g. a few seconds) while the developing roller 51, the feed screw 52 and the stirring screw 53 are rotating. Although the amount of the developer D in the housing 50 increases as the carrier is refilled, the same amount of the developer D is discharged from the outlet 90. Thus, the amount of the developer in the housing 50 does not monotonically increase, but instead repeatedly increases and decreases within a certain range.

For refilling of the toner, the density sensor detects the ratio of the toner to the carrier while the developing roller 51, etc. is rotating during the image formation operation for example. If it is determined based on the detected ratio that the toner amount is insufficient, a certain amount of toner that is necessary for satisfying a predetermined ratio is supplied from the hopper to the housing 50. The control of the refilling described above is performed by a control unit (not depicted) provided in the image formation apparatus. However, the method for controlling the refilling is merely an example, and another method may be used as long as it can be used with the trickle developing method.

The developer (i.e. carrier and toner) provided to the feed passage 98 of the stirring chamber 59 via the inlet 91 joins the flow of the developer D that has been transported from the feed chamber 58 via the opening 89, at the upstream edge (i.e. point $\alpha 3$) of the area M2 of the second transport passage 96 in the stirring chamber 59.

Subsequently, while the developer D is being stirred and transported by the stirring screw 53 through the second transport passage 96 in the stirring chamber 59, the particles of the carrier and toner thereof contact with each other and are charged, and are then the charged particles are transported to the feed chamber 58.

<Transport speed of Developer>

As described above, a) the pitches of the spiral blades of the feed screw 52 and the stirring screw 53 are the same, b) the rotation speed of the stirring screw 53 is higher than the rotation speed of the feed screw 52, and c) the heights of the paddles satisfy I12<I11. Thus, the transport speed of the stirring screw 53 is higher than the feed screw 52. Also, when the stirring screw 53 is divided into two sections, namely, the section in the area M2 and the section in the area M3 which is downstream from the area M2, the transport speed of the developer D in the section in the area M3 is higher than in the section in the area M2.

That is, V1<V2<V3 is, satisfied, where V1 denotes the average transport speed of the developer D due to the section of the feed screw 52 in the area M1, and V2 and V3 denote the average transport speed of the developer D due to the section of the stirring screw 53 in the area M2 (i.e. the upstream section) and the average transport speed of the developer D due to the section of the stirring screw 53 in the area M3 (i.e. the downstream section), respectively.

Here, the term "average transport speed" refers to the average of the transport speeds per unit time that are measured at a plurality of points in each area while the operation for image formation (i.e. development) is being performed. The accuracy of the average values improves as the number of the measurement point increases. Note that the speed measured at a particular point (e.g. the middle point in the axis direction) in each area may be used as the average speed if it is possible to approximate the speed at the point as the average speed. In the following, the average transport speed may also be referred to as simply "the transport speed".

<Surface of Developer>

Figure 7:
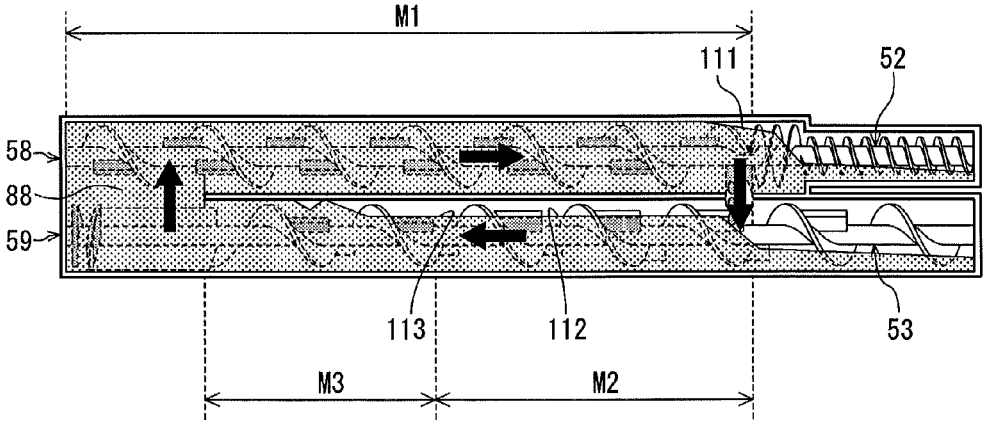
FIG. 7 schematically shows surface levels of developer in the developing unit.

If the transport speed of developer is made different from one area to another, the surface level of the developer D in the housing 50 during the image formation operation will be balanced as shown in the schematic diagram in FIG. 7.

As seen from FIG. 7, a large amount of the developer D substantially fills the area M1 in the feed chamber 58, and thus the surface level 111 of the developer D is high all along the length in the axis direction.

In contrast, the amount of the developer D in the area M2 of the stirring chamber 59 is smaller, and thus the surface 112 of the developer D is lower all along the length in the axis direction.

In the area M3 in the stirring chamber 59, the upstream portion of the surface 113 of the developer D is substantially at the same level as in the area M2, but the downstream portion thereof is higher than in the area M2, and a large amount of developer substantially fills the downstream section of the stirring chamber 59.

Such a difference in the amount (i.e. surface level) of the developer D is due to the relationship V1<V2<V3 is satisfied between the respective transport speeds in the areas M1 through M3.

That is, since the transport speed V1 in the area M1 is lower than the transport speeds V2 and V3 in the areas M2 and M3, the developer D is more likely to be accumulated in the area M1 than in the areas M2 and M3. Thus, the amount of the developer increase and the surface 111 will be kept at a high level.

In the area M2, on the other hand, the transport speed V2 is higher than the transport speed V1 in the area M1. Thus, the developer D more quickly passes through the area M2 than in the area M1 due to the difference of the transport speeds, and the developer remains in the area M2 for a shorter period than in the area M1. Accordingly, the amount of the developer in the area M2 will be smaller than in the area M1, and the surface 112 of the developer D will come down.

In the area M3, the transport speed V3 is higher than the transport speed V2 in the area M2. The area M2, however, communicates with the area M1 via the opening 88. The area M1 is with the lowest transport speed, and the developer D is likely to be accumulated therein. Therefore, near the opening 88 as the entrance of the area M1, the transport speed drops to about the same level as the transport speed V1 in the area M1, and thus the developer D is likely to accumulate from the opening 88 toward the upstream edge.

In the area M3, due to the accumulation near the opening 88, the upstream portion of the surface 113 will be substantially at the same level as in the area M2 and the downstream portion of the surface 113 will be kept at a higher level than the upstream portion.

It can be assumed that such differences in the surface level in the areas M1 through M3 are caused when the transport speeds in the areas of the circulation passage are different, through a process in which the surface levels in the areas are gradually determined with time based on the lowest transport speed and finally will be balanced.

Figure 8:
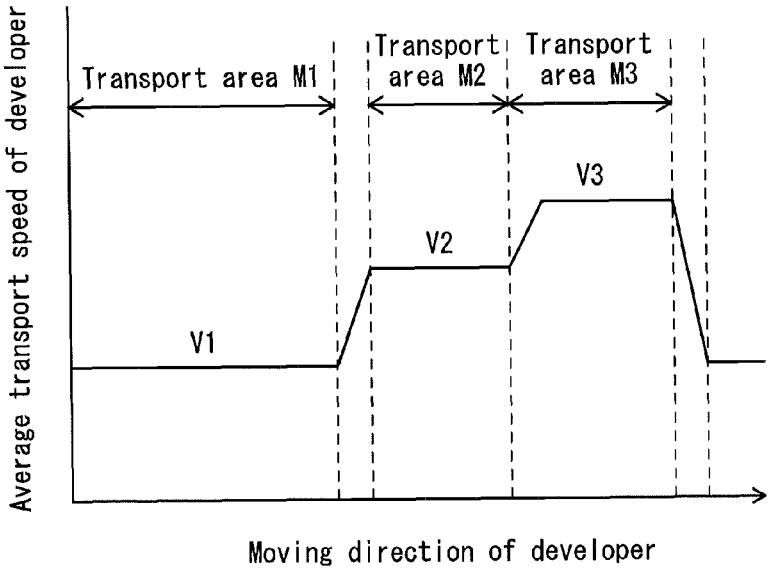
FIG. 8 schematically shows the relationship between transport areas and average transport speeds of developer.

FIG. 8 schematically shows the relationship between the transport areas M1-M3 and the average transport speeds V1-V3 of developer. As seen from FIG. 8, while the developer moves through the areas M2 and M3 and returns to the area M1, the transport speed changes to V1, V2 and V3 in this order, and the transport speed drops from V3 to V1 in the communication passage between the areas M3 and M1.

An experiment was performed to test transportation capability in each area. The transportation capability is represented by the amount of developer that can be transported per second. The experiment was performed under the following conditions, for example: the total amount of developer is 300 [g]; the diameter and the pitch of the spiral blade 62 of the feed screw 52 are 16 [mm] and 30 [mm], respectively; the diameter and the pitch of the spiral blade 72 of the stirring screw 53 are 16 [mm] and 30 [mm], respectively; the height H0 of the paddles 65 is 5 [mm]; the height H1 of the paddles 73 is 5 [mm]; and the height H2 of the paddles 74 is 3 [mm].

Figure 9A:
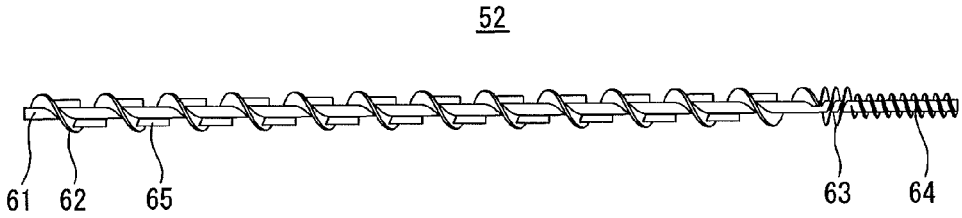
FIG. 9A and FIG. 9B show an example of the feed screw and an example of the stirring screw, respectively.
Figure 9B:
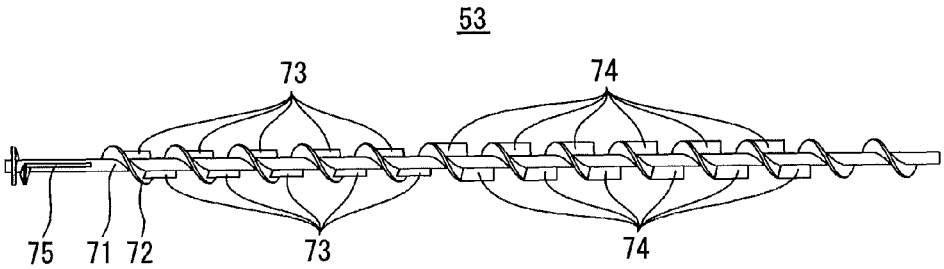

Note that the feed screw 52 and the stirring screw 53 shown in FIGS. 9A and 9B were used in the experiment. The feed screw 52 and the stirring screw 53 are capable of transporting the same amount of developer per rotation, and the rotation speed of the stirring screw 53 is in the range from 1.1 times to 1.3 times the rotation speed of the feed screw 52.

To test the transportation capability of each area, a value indicating the capability was obtained by dividing the amount X [g] of developer that exists in the area by the time T [sec.] that the developer takes to pass through the area.

(1) Have a developer circulating the circulation passage, the developer containing toner and carrier at a constant ratio (i.e. density), and monitor changes in density of the developer (i.e. the rate of toner to carrier) at the upstream end point A and the downstream end point B in each area by using sensors;

(2) After turning on a timer to start, input a predetermined amount of toner at the point A;

(3) The density of developer at the point A increases at the instant when toner is input, according to the amount of the toner (i.e. the waveform showing the density reaches a peak). Read a counter value T1 when the density has increased.

The input toner is transported along the circulation passage together with the developer which is being transported along the circulation passage. Since the density of the developer in the housing is constant throughout the housing, the density (i.e. the ratio of toner to carrier) in only the portion where the input toner exists increases, and this high-density portion moves along the circulation passage.

Thus, by detecting the time point when the density of the developer at the point B instantly increases (i.e. the occurrence of the peak in the waveform of the density), it can be determined that the high-density portion (in which the input toner exists) passes through the point B at the time point.

(4) Read the counter value T2 when the density of the developer at the point B instantly increases, and obtain a value T2−T1. The value T2−T1 indicates the time that the input toner takes to reach the point B from the point A, in the transportation direction, and equals to the time that the developer takes to pass through one area. Thus, the value T2−T1 equals to the time T mentioned above. The time T is obtained for each area by calculating T2−T1 for each area. The time T may be the average of values T2−T1 calculated every time the developer circulates the entire passage once.

(5) Stop the transportation of the developer after calculating the time T for each area. Then, for each area, extract a potion of developer that exists between the point A and the point B, measure the amount of the extracted portion. This measured amount is the developer amount X mentioned above.

(6) Calculate the transportation capability X/T [g/sec.] for each area. Note that the transportation capability may be obtained by a different method.

According to the test, the transportation capability was approximately 25 [g/sec.] in the area M1, approximately 30 [g/sec.] in the area M2, and approximately 35 [g/sec.] in the area M3. It can be concluded that the transportation capability increases in the order of M1, M2 and M3 because the transport speeds of the develop D satisfy the relationship V1<V2<V3.

The surface levels of the developer in the housing 50 are substantially the same as shown in FIG. 7.

The total amount of the developer was 300 [g], approximately 180 [g] of which was in the feed chamber 58 and approximately 120 [g] of which was in the stirring chamber 59. In the feed chamber 58, approximately 60 [g] was carried by the developing roller 51, and approximately 120 [g] was transported by the feed screw 52. The ratio of the developer amount in the feed chamber 58 to the developer amount in the stirring chamber 59 changes within a certain range during the image formation operations. However, it was found that the amount of the developer D existing near the developing roller 51 is within the range from approximately 60 [%] to approximately 70 [%].

Figures 10, 11:
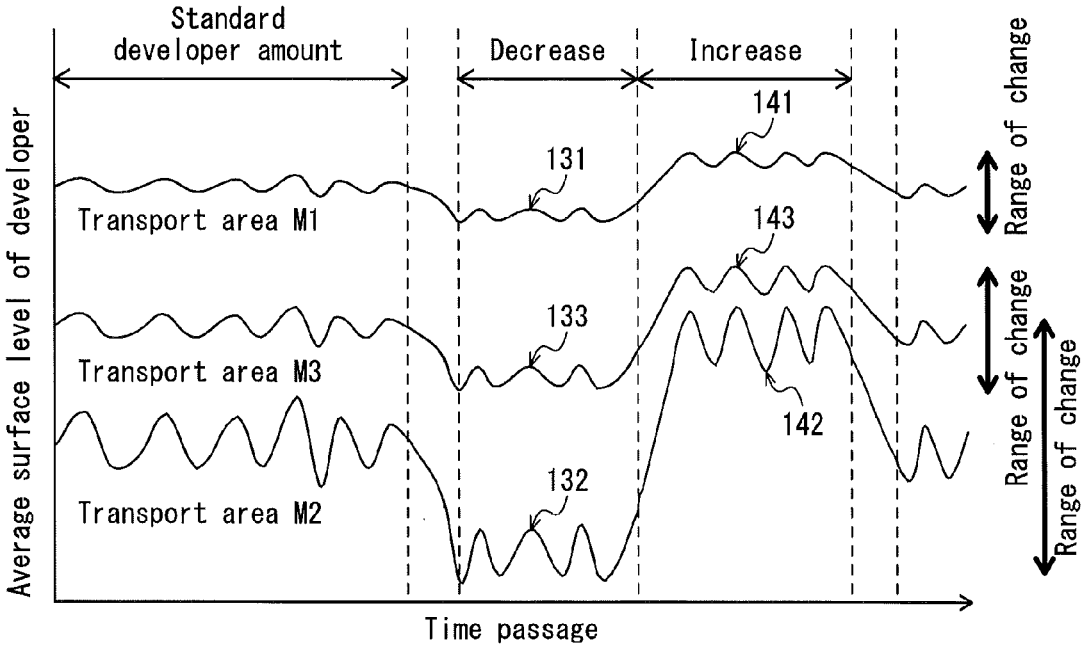
FIG. 10 schematically shows changes of average surface levels of developer in the transport areas.
FIG. 11 shows a table for evaluating the image quality in a practical example and comparative examples.

FIG. 10 schematically shows the changes of the average surface levels in the areas M1 through M3 as the developer amount in the housing 50 changes with time.

Here, the changes of the average surface levels are caused by the following operations that are repeatedly performed: an operation in which developer is refilled and discharged concurrently according to the trickle developing method; and an operation in which developer is refilled when toner is consumed due to development during the image formation.

As shown in the drawing, the average level of the developer is the highest in the area M1, and is the lowest in the area M2. Also, the range of the changes of the level (i.e. the difference between the lowest level and the highest level) is the narrowest in the area M1 and is the widest in the area M2.

FIG. 10 is similar to FIG. 7 in that the average level of the developer is the highest in the area M1, and is the lowest in the area M2.

The range of the changes of the level while the developer amount changes is the narrowest in the area M1 for the following reason.

As described above, in the circulation passage 101, the developer amount in the areas M2 and M3 are determined in relation to the developer amount in the area M1, in which the transport speed of developer is the lowest. Since the transport speeds V1-V3 are constant regardless of the developer amount. Thus, as the total developer amount changes, the developer amounts in the areas M2 and M3 are determined according to the amount of the change.

Since the transport speed is the lowest in the area M1, the developer D is more likely to accumulate than in the areas M2 and M3. Thus, the developer amount is greater in the area M1 (feed chamber 58) than in the areas M2 and M3 (stirring chamber 59).

Thus, even when the total developer amount is decreased from a reference time point, the developer amounts will be balanced (i.e. the change in the developer amount converges) and come into the state where a greater amount of developer exists in the area M1, which is with the lowest transport speed, than in the areas M2 and M3. As seen from the waveform 131 in FIG. 10, even when the level of the developer in the area M1 lowers due to the decrease of the total developer amount from the reference time, the lowering immediately stops (i.e. does not last for a long period), and the level remains within a small variation range. Thus, in the area M1, the amount of decrease from the reference time point is small, and the level of the developer lowers by only a small amount.

Since a greater mount of the developer D, whose total amount is decreased, is collected in the area M1, the amount of developer transported in the area M2 is decreased. Thus, in the area M2, the level in the area M2 from the reference time point remarkably lowers (c.f. the waveform 132 in FIG. 10).

In the area M3, in the developer D accumulates from the opening 88, which communicates with the area M1, toward the upstream edge. This is the same as before the change of the developer amount. Thus, the amount of the developer in the area M3 remains to be greater than in the area M2. Therefore, the level of the developer D in the area M3 lowers by only a small amount (c.f. the waveform 133 in FIG. 10).

On the other hand, when the total developer amount increases from the reference time point, it is the same that the developer amounts in the areas M2 and M3 are determined in relation to the developer amount in the area M1, in which the transport speed of developer is the lowest.

Therefore, in the case the total developer amount increases from the reference time point, the developer amount in the area M1 increases by only a small amount (c.f. the waveform 141 in FIG. 10), and developer that overflows from the area M1 due to the increase moves to the areas M2 and M3 in which only a small amount of developer is originally contained (c.f. the waveform 142 and 143 in FIG. 10). Thus, the developer in the area M1 is prevented from being excessive, and the surface level thereof does not increase extremely.

Note that the surface level in the area M2 increases greater than in the area M3 because the developer D in the area M3 is still accumulating from the opening 88 toward the upstream edge even after the change, and a large part of the increased portion does not move into the area M3. Thus, the developer amount in the area M2 increases by a great amount.

As described above, the change of the developer amount is absorbed by the area M2 (i.e. the upstream section of the second transport passage 96) in the circulation passage 101, which is provided separately from the area M1 (i.e. the first transport passage 95) which provides the developing roller 51 with the developer D. Thus, during the transportation, the surface level of the developer D in the feed chamber 58 (i.e. the first transport passage 95) does not greatly change from the reference time point.

This means that the developer amount in the feed chamber 58 does not change greatly during the transportation. Thus, even if the amount of developer in the housing 50 changes within a certain range due to the trickle developing method, the developing roller 51 remains to be provided with a required amount of developer. This prevents degradation of the developing performance due to the shortage of supplied developer.

Also, as shown in FIG. 8, the transport speed V2 in the area M2 is lower than the transport speed V3 in the area M3, and thus the time that the refill developer input from the inlet 91 takes to reach the area M3 in the stirring chamber 59 via the area M2 (i.e. the time that the developer takes to pass through the area M2) is longer than in the case where the transport speed in the area M2 is no less than V3.

The refill developer is charged while being stirred and transported in the stirring chamber 59, due to frictional contact between the particles thereof, for example. Thus, the amount of charged electricity increases as the time length for which the developer is stirred and transported. Thus, when the transport speed V2 in the area M2 is set to be lower than V3, a required amount of charged electricity can be secured, and this prevents degradation of the developing performance due to the shortage of the charge on the developer.

<Developing Performances of Practical Example and Comparative Examples>

FIG. 11 shows test results of the developing performances (i.e. stability, feeding performance, fogging level) of a practical example and comparative examples 1-3. The practical example satisfies the same relationship among the average transport speeds V1-V3 of the developer D as Embodiment 1, and the comparative examples each satisfy a relationship difference from Embodiment 1.

(a) The term "stability" shows whether the density of the formed image will remain within a predetermined range (i.e. the density is kept stable) when a number of sheets are consecutively passed through during the image formation operation.

In the developing unit 14, the developer D in the feed chamber 58 is carried by the magnetic force caused by the magnetic pole N1 of the developing roller 51, reaches the developing position F while being carried by the developing roller 51, and is released at the magnetic pole N3 after passing by the developing position F. These procedures are repeatedly performed.

If the surface level of the developer D in the feed chamber 58 is kept at a high level, a great portion of the developer D is likely to be carried by the developing roller 51 at the magnetic pole N1. Thus, even if toner is continuously consumed for a relatively long period as in the case where a large number of sheets are consecutively transported, the developing roller 51 can be constantly provided with the consumed amount of toner from the feed chamber 58, which maintains the image density during the sheet transportation.

On the other hand, if the surface level of the developer D in the feed chamber 58 is low or repeatedly changes, the developer D is not likely to be carried at the magnetic pole N1 of the developing roller 51, and the amount of toner to be provided to the developing roller 51 changes with time. This makes it difficult to maintain the image density.

In view of the above, the "stability" was examined by running a job for forming a K color (i.e. black) solid image over the whole surface of each of N (e.g. 200) A4 sheets that are consecutively fed, and determining whether the densities of the images on the 1st through Nth sheets are maintained at a predetermined level. The density given as the predetermined density was not the maximum density, but it was determined such that images with the density are perceivable as solid black images by human eyes.

(b) The term "feeding performance" shows whether the developing roller 51 is provided with a required amount of developer D when an image with the maximum density is formed.

Specifically, even when a large amount of toner is consumed in a short period due to formation of images with the maximum density, if the total amount of developer in the feed chamber 58 is greater than a certain amount, the developing roller 51 will be newly provided with the developer D from the feed chamber 58, whose toner has not been consumed at all, immediately after the developer D, from which toner has been consumed, is released from the magnetic pole N3 of the developing roller 51.

On the other hand, if only a small amount of developer is contained in the feed chamber 58, this means that the amount of developer that can be provided to the developing roller 51 is small. Thus, if this is the case, it is very likely that the developing roller 51 will not be supplied with a sufficient portion of the developer D. Such a shortage of developer lowers the image density in the development.

A shortage of developer to be supplied to the developing roller 51 becomes more likely to be caused along with the increase of the toner consumption amount per unit time in the development. The toner consumption amount is at its maximum when a solid image with the maximum density is formed.

In view of this relationship, the "feeding performance", by which the developer D is provided to the developing roller 51, was examined by running a job for forming a solid image on each of a plurality of (e.g. three) sheets that have the maximum size (e.g. A3 size) and are consecutively fed, and determining whether any of the formed solid images contain a part with a lower density than the maximum density (i.e. a part with a lighter color).

(c) The term "fogging" shows whether toner exists in blank space on a sheet when an image containing a non-image-formation part (i.e. blank space) is formed on a single sheet. In a literal sense, the "blank space" is space in which no toner should be provided. However, if charge on the developer D (in particular, refilled toner particles) falls short of a required amount in the developing unit 14, part of the toner particles without sufficient charge may be transferred onto an area in the electrostatic latent image on the photosensitive drum 11, the area corresponding to the blank space, due to electrostatic force caused by bias voltage generated in the development. If this is the case, the particles appear on the blank space as if they are scattered on the space. This phenomenon is called "fogging".

In this test, the stability and the feeding performance were each rated "good" (○), "undesirable" (Δ), or "failure" (x). The rating "good" (○) corresponds to a density range Z1, within which the decrease of the density of the solid image is not perceivable by human eyes. The rating "undesirable" (Δ) corresponds to a density range Z2, within which the decrease of the density is perceivable, but not remarkable. The rating "failure" (x) corresponds to a density range Z3, within which the decrease of the density is perceivable and remarkable. The range was determined by measuring the reflectivity of the solid image with a reflection densitometer.

Similarly, the fogging level was rated "good" (○), "undesirable" (Δ), or "failure" (x). The rating "good" (○) corresponds to a density range Z4, within which fogging is not perceivable by human eyes. The rating "undesirable" (Δ) corresponds to a density range Z5, within which the fogging is perceivable, but not remarkable. The rating "failure" (x) corresponds to a density range Z6, within which the fogging is perceivable and remarkable. The range was determined by measuring the reflectivity of the blank space with a reflection densitometer.

As seen from the drawing, the practical example (V1<V2<V3) is preferable as to all the aspects, namely the stability, the feeding performance and the fogging level. The practical example achieves such preferable stability and feeding performance because of the following reasons.

That is, since the transport speeds of the developer D satisfy the relation ship V1<V2<V3, the feed chamber 58 is provided with a greater portion of the developer D than the stirring chamber 59, and thus a greater amount of developer is transported to the feed chamber 58.

Thus, the developing roller 51 is provided with a sufficient amount of developer D even if the developer amount varies within a certain range, and the developing roller 51 is kept being provided with toner even while image formation operations are consecutively performed on a large number of sheets (i.e. stability). Also, even in the case of forming solid images with the maximum density, the amount of the developer D to be fed to the developing roller 51 does not fall short, and the maximum density can be maintained (i.e. feeding performance).

Also, the aspect of the "fogging level" of the practical example is "good", because the developer D is charged to the level required for development, before it is transported and reaches the feed chamber 58. Specifically, in the stirring chamber 59, the transport speed V2 in the area M2 is set to be lower than the transport speed V3 in the area M3 which is downstream from the area M2. Thus, in the course of the passage to the feed chamber 58 via the areas M2 and M3, the developer D (carrier and toner), which has been input from the inlet 91, takes a long time to pass through the area M2. Therefore, the developer D is sufficiently stirred while passing through the area M2, and toner particles are charged to the level required for development.

On the other hand, each of the comparative examples 1-3 shows at least one "failure".

For example, in the comparative example 1 (V1=V2=V3) and the comparative example 2 (V1>V2=V3), the feeding performance is "failure". This is because the transport speed V1 in the area M1 of the comparative examples 1 and 2 is not the lowest among the transport speeds in the areas M1-M3.

That is, in the comparative examples 1 and 2, the transport speed V1 is equal to or higher than the transport speed V2 in the area M2. If the transport speed V1 is high, the developer D is unlikely to accumulate in the area M1 (feed chamber 58), and it is impossible to increase the developer amount in the feed chamber 58. Also, as described above, the developer amount in each area is determined in relation to the developer amount in the area with the lowest transport speed. Thus, when compared with the practical example, the surface level in the area M1 of the comparative examples 1 and 2 is lower and the surface level in the area M2 of the comparative examples 1 and 2 is higher.

In the comparative examples 1 and 2, since the ratio of the developer amount in the feed chamber 58 can not be increased, the developer amount in the feed chamber 58 is smaller than in the practical example. Thus, when the total amount of the developer D changes, the surface level in the feed chamber 58 greatly changes, and the developing roller is likely not to be provided with a sufficient developer.

In the comparative example 3 (V1<V2=V3), the stability and the feeding performance are "good". This is because the transport speed V1 in the area M1 is the lowest, and the ratio of the developer amount in the feed chamber 58 can be increased in the same manner as in the practical example.

In the comparative example 3, however, the fogging level is "failure". This is because the transport speed V2 in the area M2 and the transport speed V3 in the area M3 are the same, and the refill developer (carrier and toner) takes a shorter time to pass through the area M2 than in the practical example, which causes shortage of charge on the toner, leading to the occurrence of fogging. Although the explanation above is for the test results of the developing unit 14 for the K color, the developing units 14 for other colors, Y-C, produced similar results.

Here, note that when the relationship V1<V2<V3 is satisfied, if only V1 is set to be extremely small by, for example, setting the pitch of the feed screw 52 to be extremely small, the area M1 (the first transport passage 95) in the feed chamber 58 will be blocked with the developer D and the developer D can not circulate.

If only V3 is set to be extremely large by, for example, setting the pitch of the stirring screw 53 to be extremely large only in the downstream section thereof, the amount of developer to be transported in the stirring chamber 59 (the second transport passage 96) toward the opening 88 increases. However, V1 in the feed chamber 58 is low, and thus the developer D accumulates near the opening 88.

Moreover, in the area M2 in the stirring chamber 59 (i.e. the upstream section of the second transport passage 96), the developer amount is extremely decreased, and it will be impossible to absorb the variations of the developer amount in the area M2 as shown in FIG. 10.

Thus, the values of V1, V2 and V3, satisfying the relationship V1<V2<V3, are determined so as to also realize smooth circulation of the developer D and balanced surface levels in the areas as shown in FIG. 10.

As described above, with the developing unit 14 pertaining to Embodiment 1, the average transport speeds V1-V3 of the developer D in the areas M1-M3 are determined to satisfy the relationship V1<V2<V3. Thus, a) the ratio of the developer amount is greater in the feed chamber 58 than in the stirring chamber 59, and, at the same time, b) the refill toner, which is transported from the area M2 (i.e. the upstream side) to the feed chamber 58 via the area M3 (i.e. the downstream side), is sufficiently stirred while passing through the area M2 and thus the toner is charged to the level required for development, as it takes a long time to pass through the area M2.

Even when the developer amount in the housing 50 changes within a certain range because of the trickle developing method, the stated structure prevents the density of the high-density image from decreasing due to the shortage of the develop D supplied to the developing roller 51. Also, it prevents the occurrence of fogging on the blank space due to the shortage of the charge on the developer D.

Accordingly, even in the case of a downsized apparatus whose developing unit houses a smaller amount of developer than conventional apparatuses, the stated structure more effectively prevents degradation of the developing performance due to the change in the developer amount, compared to conventional structures designed to make the surface level constant throughout the circulation passage.

Note that the above description is given only to a case in which preferable development performance was achieved when the rotation speed of the stirring screw 53 is 1.1-1.3 times the rotation speed of the feed screw 52. However, other rotation speed ratios may be preferable, depending on the configuration of the apparatus.

Also, although the above description is given to the case of a developing unit that uses a trickle developing method, the stated structure is also applicable to general developing apparatuses such as apparatuses that use a standard developing method other than the trickle developing method (e.g. a method in which two-component developer is used, toner is refilled but carrier is not refilled, and developer is not discharged). This is because the stated structure effectively prevents degradation of the developing performance when the developer amount is smaller than the standard amount, and the same applies to the, case of a downsized apparatus whose developing unit houses a smaller amount of developer than conventional apparatuses.

When such a standard method is used, the area N1 in the feed chamber 58 and the area N2 in the stirring chamber 59 may not be provided (i.e. the whole length of the feed chamber 58 and the stirring chamber 59 along the axis direction is shorter by the length of the area N1 and the area N2). The outlet 90 is unnecessary as it is unnecessary to discharge the developer D. However, the inlet 91 for refilling toner is necessary.

The inlet 91 may be provided at the upstream edge of the area M2 in the stirring chamber 59. The toner refilled from the inlet 91 is charged to the level required for development while being transported through the area M2.

[Embodiment 2]

In Embodiment 1 above, the pitch of the feed screw 52 and the pitch of the stirring screw 53 are the same. In Embodiment 2, the pitches are different. This is the difference from Embodiment 1. In the following, the same explanation as for Embodiment 1 is omitted, and the same components are identified with the same reference signs.

Figure 12:
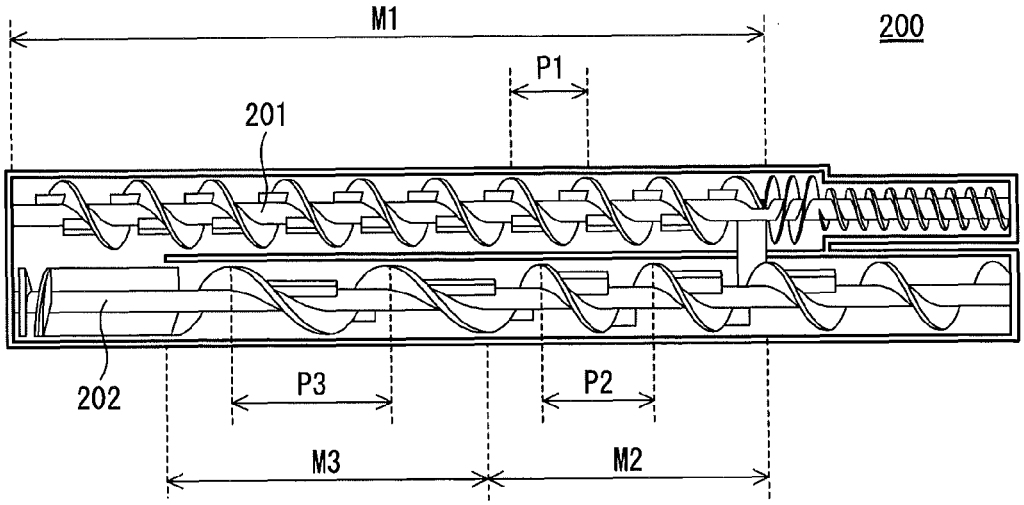
FIG. 12 shows an example structure of a developing unit pertaining to Embodiment 2.
Figure 13:
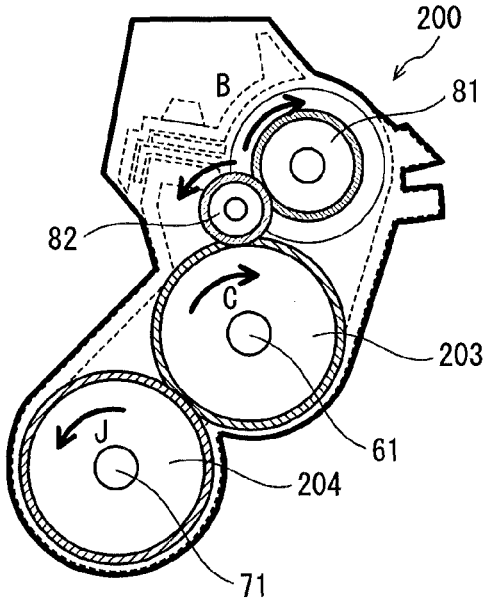
FIG. 13 shows an example structure of a transmission mechanism pertaining to Embodiment 2.

FIG. 12 shows the structures of the feed screw 201 and the stirring screw 202 to be provided in the developing unit 200 of Embodiment 2. FIG. 13 is a side view showing the structure of a mechanism for transmitting driving force to the feed screw 201 and the stirring screw 202.

As shown in FIG. 12, P1<P2<P3 is satisfied, where P1 denotes the pitch of the section of the spiral blade of the feed screw 201 within the area M1, P2 denotes the pitch of the section of the spiral blade of the stirring screw 202 within the area M2, and P3 denotes the pitch of the section of the spiral blade of the stirring screw 202 within the area M3.

As also shown in FIG. 13, the gear 203 attached to the rotation shaft 61 of the feed screw 52 and the gear 204 attached to the rotation shaft 71 of the stirring screw 53 have the same size and the same number of teeth. Thus, the feed screw 201 and the stirring screw 202 rotate at the same rotation speed.

Since the feed screw 201 and the stirring screw 202 have the same rotation speed and the pitches of the spiral blade sections satisfy the relationship P1<P2<P3, the transport speeds V1-V3 satisfy the same relationship V1<V2<V3 as in Embodiment 1.

Note that the feed screw 201 and the stirring screw 202 are provided with paddles that have the same shape as in Embodiment 1, and the height thereof is predetermined within the range that satisfies the relationship V1<V2<V3. Depending on the configuration of the apparatus, paddles may not be provided.

With the stated structure in which the pitches of the spiral blade sections of the feed screw 201 and the stirring screw 202 are different and in which drive gears have the same size, it is possible to configure the apparatus such that the transport speeds V1-V3 of the developer D satisfy the relationship V1<V2<V3 while reducing the cost and facilitating the assembling process.

[Modifications ]

The present invention is described above based on the embodiments. However, the present invention is not limited to the embodiments as a matter of course. The following are possible modifications.

(1) In the embodiments above, the stirring chamber 59 is divided at the middle point (i.e. point $\alpha$2) in the axis direction, into the upstream area M2 and the downstream area M3. However, the stirring chamber 59 may be divided at a point different from the middle point, i.e., at a point closer to one edge or the other edge of the stirring chamber 59.

It is only necessary that the speed V2 of the developer transported by the upstream section of the stirring screw 53 (i.e. the portion in the area M2), and the speed V3 of the developer transported by the downstream section of the stirring screw 53 (i.e. the portion in the area M3) satisfy the relationship V2<V3.

(2) In Embodiment 1 above, the height H1 of the paddles 73, which is provided on the section of the rotation shaft 71 within the area M2, is higher than the height H2 of the paddles 74, which is provided on the section of the rotation shaft 71 within the area M3, so that the transport speeds V2 and V3 satisfy the relationship V2<V3. However, this is not essential. It is only necessary that the relationship V2<V3 is satisfied. For example, the paddles 73 and 74 may not be provided. Instead, the pitch P2 of the section of the spiral blade 72 of the stirring screw 53 within the area M2 may be determined to be shorter than the pitch P3 of the section within the area M3. Also, the shape, size and number of the paddles 65 and 73-75 are not limited to those described above. Depending on the configuration of the apparatus, the configuration of the paddles may be altered. For example, it is possible that no paddle is provided, or the shapes and sizes of adjacent paddles are different.

(3) In Embodiment 1, the paddles 65 are provided on the rotation shaft 61 of the feed screw 52. However, the present invention is not limited to this, and it is possible that no paddle 65 is provided. Paddles can be used for adjusting the transport speed of the developer D. However, paddles are not necessary when it is possible to satisfy the relationship V1<V2<V3 by adjusting the rotation speeds and pitches of the feed screw 52 and the stirring screw 53.

(4) In the embodiments above, the paddles 75, provided near the downstream edge of the stirring screw 53, are used for scooping the developer D. However, it is not essential that the paddles 75 are provided. For example, the spiral blade 72 may be extended to the downstream edge of the stirring screw 53, instead of providing the paddles 75. Such a configuration is acceptable as long as the relationship V1<V2<V3 is satisfied.

(5) In the embodiments above, the stirring chamber 59 is located in the obliquely downward direction of the feed chamber 58 as shown in FIG. 2 so that the width of the developing unit 14 (i.e. the length in the lateral direction of FIG. 2) is made shorter, and the developing unit 14 is downsized in the width direction. However, the present invention is not limited to this. It is possible to more effectively downsize the developing unit 14 by locating the stirring chamber 59 constituting the second transport passage 96 blow the feed chamber 58 constituting the first transport passage 95, compared to the case in which they are horizontally located. For example, the stirring chamber 59 may be located just below the feed chamber 58. In the case the main body of the apparatus has a space for housing, the feed chamber 58 and the stirring chamber 59 may be located along the horizontal surface (i.e. horizontally).

In the embodiments above the feed chamber 58 is located in the obliquely downward direction of the photosensitive drum 11 and the stirring chamber 59 is located in the obliquely downward direction of the feed chamber 58. However, depending on the configuration of the image creating unit, it is possible that the photosensitive drum 11 is located at the lowest level, the feed chamber 58 is located above (i.e. just above or in the obliquely upward direction of) the photosensitive drum 11, and the stirring chamber 59 is located above the feed chamber 58.

(6) In the embodiments above, the feed screw 52 and the stirring screw 53 provided with the protruding spiral blades are used as examples of the rotative transport member for rotating and transporting the developer D. However, it is not essential to use such spiral blades, and any transport member may be used as long as it rotates and transports the developer D. For example, a spiral groove in the rotation shaft, which serves as a screw, may be used instead.

In the embodiments above, the feed screw 52 and the stirring screw 53 are driven by rotational drive force from the driving motor 45. However, when the developing unit 14, for example, has a driving source, the screws may be driven by the drive source. Also note that the feed screw 52 and the stirring screw 53 may be driven independently.

(7) The embodiments above are examples in which the developing device and image formation apparatus pertaining to the present invention is adopted in a tandem-type color digital printer. However, the present invention is not limited to this. The developing device and the image formation apparatus may be adopted in, for example, copiers, fax machines and MFPs (Multiple Function Peripherals), regardless of whether it is a color apparatus or a monochrome apparatus.

In the embodiments above, the photosensitive drum is used as an example of the image carrier. However, the image carrier is not limited to this. For example, a cylindrical member, a columnar member, or a belt-like member may be used. In the embodiments above, the developing roller 51 is used as the developer carrier that faces the image carrier. However, any member may be used as long as it can carry the developer D on the surface thereof.

Also, the shapes, sizes and so on of the members such as the feed screw 52 and the stirring screw 53 are not limited to those described above. In the embodiments above, to restrict the amount of discharge due to the trickle developing method, the feed screw 52 is provided with the spiral blade 63, which is wound in the opposite direction s the feed screw 52. However, the spiral blade 63 may be not provided, depending on the configuration of the apparatus.

(8) In the embodiments above, the opening 89 (i.e. the first communication passage) and the area N1 (i.e. the discharge passage 97 for developer) branches off at the downstream edge of the area M1 of the feed chamber 58 (i.e. the first transport passage 95). However, the branching position is not limited to this. For example, the discharge passage may branch from a point in the middle of the first transport passage 95. In the embodiments above, the flow of developer in the area N2 of the stirring chamber 59 (i.e. the feed passage 98 for developer) joins the flow of developer in the area M2 at the upstream edge of the area M2 (i.e. the upstream edge of the second transport passage 96). However, the flow of developer in the area N2 may joint the flow of developer in the area M2 in the middle of the area M2, depending on the configuration of the apparatus.

Also, as described above, the present invention is applicable not only to apparatuses using a trickle developing method, but also to apparatuses using a standard developing method. The two-component developer, containing carrier and toner, may also contain an additive substance or the like. Alternatively, the present invention may be applied to a structure in which one-component developer, which contains toner but which does not contain carrier, is used. The present invention may be any combinations of the embodiments and modifications described above.

<Summary>

Embodiments above and Modifications descried above show one aspect of the present invention which solves the problems described in the Background Art section. Embodiments and the Modifications can be summarized as follows.

One aspect of the present invention is a developing device comprising: a first transport passage; a first transport member disposed in the first transport passage and configured to rotate and thereby transport developer along the first transport passage in a first transport direction, the developer containing toner; a second transport passage; a second transport member disposed in the second transport passage and configured to rotate and thereby transport the developer along the second transport passage in a second transport direction; and a developer carrier disposed along the first transport passage and configured to carry the developer supplied from the first transport passage, wherein the second transport passage is composed of an upstream section and a downstream section with respect to the second transport direction, the second transport passage communicates with the first transport passage via a first communication passage and a second communication passage, the first communication passage being connected to the upstream section, the second communication passage being connected to the downstream section, and the first transport passage, the first communication passage, the second transport passage, and the second communication passage constituting a circulation passage for circulating the developer, the upstream section is configured to receive refill toner, and $V1<V2<V3$, where V1 denotes an average transport speed of the first transport member, V2 denotes an average transport speed of a section of the second transport member within the upstream section of the second transport passage, and V3 denotes an average transport speed of a section of the second transport member within the downstream section of the second transport passage.

The developing device may further comprise: a discharge passage branching from the first transport passage; and a feed passage joining the upstream section of the second transport passage, wherein the developer may be two-component developer that contains carrier and toner, the upstream section may receive refill carrier in addition to the refill toner via the feed passage, and a portion of the developer that is being transported through the first transport passage may be discharged via the discharge passage.

The developing device may further comprise: a housing divided into a feed chamber and a stirring chamber by a partition, wherein the first transport passage may he provided in the feed chamber, the second transport passage may be provided in the stirring chamber, the first transport member may be housed in the feed chamber, the second transport member may be housed in the stirring chamber, the first communication passage and the second communication passage respectively may pass through a first opening and a second opening provided in the partition with an interval in the second transport direction, and the feed chamber and the stirring chamber may be arranged non-horizontally with respect to each other.

The second transport member may include a shaft and a paddle, the paddle protruding perpendicularly from a section of the shaft that is adjacent to the second communication passage, and configured to transport the developer, which has been transported through the second transport passage, to the first transport passage via the second communication passage.

A width of the paddle in the second transport direction may be substantially equal to a width of the second communication passage in the second transport direction.

The second transport member may be divided in the middle of the second transport passage into the section within the upstream section of the second transport passage and the section within the downstream section of the second transport passage.

The first transport member and the second transport member may be transport screws each having a shaft and a spiral blade with the same pitch, a rotation speed of the second transport member may be higher than a rotation speed of the first transport member, the second transport member may further have paddles that are disposed along the shaft thereof at intervals, protrude perpendicularly from the shaft, and are configured to restrict transportation of the developer in the second transport direction, and heights of the paddles may be greater in the upstream section than in the downstream section.

The rotation speed of the second transport member may be within a range from 1.1 to 1.3 times the rotation speed of the first transport member.

The first transport member and the second transport member may be transport screws each having a spiral blade, and $P1<P2<P3$, where P1 denotes a pitch of the spiral blade of the first transport member, P2 denotes a pitch of the spiral blade of the second transport member in the upstream section, and P3 denotes a pitch of the spiral blade of the second transport member in the downstream section.

A rotation speed of the first transport member may be the same as a rotation speed of the second transport member.

Another aspect of the present invention is an image forming apparatus having the developing device defined above.

With the stated structure in which the average transport speeds of developer satisfies the relation $V1<V2<V3$, the ratio of the amount of developer existing on the first transport passage is greater than the ratio of the amount of developer existing on the second transport passage.

Thus, even if the amount of developer changes within a certain range, the ratio of the change amount to the amount of existing developer is smaller on the first transport passage than on the second transport passage. Thus, the first transport passage is less affected by the changes in the developer amount. This prevents the amount of developer to be provided to the developer carrier from decreasing greatly and affecting the developing performance.

Also, since the transport speed is lower in the upstream section of the second transport passage than in the downstream section, the refill toner is charged to the level required for development by being stirred while being transported at a low speed in the upstream section of the second transport passage. This prevents the shortage of the charge at the time the developer reaches the first transport passage via the downstream section. Consequently, it is possible to realize downsizing of the apparatus and prevention of degradation of developing performance at the same time.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A developing device comprising:

a first transport passage;

a first transport member disposed in the first transport passage and configured to rotate and thereby transport developer along the first transport passage in a first transport direction, the developer containing toner;

a second transport passage;

a second transport member disposed in the second transport passage and configured to rotate and thereby transport the developer along the second transport passage in a second transport direction; and a developer carrier disposed along the first transport passage and configured to carry the developer supplied from the first transport passage, wherein the second transport passage is composed of an upstream section and a downstream section with respect to the second transport direction, the second transport passage communicates with the first transport passage via a first communication passage and a second communication passage, the first communication passage being connected to the upstream section, the second communication passage being connected to the downstream section, and the first transport passage, the first communication passage, the second transport passage, and the second communication passage constituting a circulation passage for circulating the developer, the upstream section is configured to receive refill toner, and $V1<V2<V3$, where V1 denotes an average transport speed of the first transport member, V2 denotes an average transport speed of a section of the second transport member within the upstream section of the second transport passage, and V3 denotes an average transport speed of a section of the second transport member within the downstream section of the second transport passage.

2. The developing device of claim 1 further comprising:

a discharge passage branching from the first transport passage; and a feed passage joining the upstream section of the second transport passage, wherein the developer is two-component developer that contains carrier and toner, the upstream section receives refill carrier in addition to the refill toner via the feed passage, and a portion of the developer that is being transported through the first transport passage is discharged via the discharge passage.

3. The developing device of claim 1 further comprising:

a housing divided into a feed chamber and a stirring chamber by a partition, wherein the first transport passage is provided in the feed chamber, the second transport passage is provided in the stirring chamber, the first transport member is housed in the feed chamber, the second transport member is housed in the stirring chamber, the first communication passage and the second communication passage respectively pass through a first opening and a second opening provided in the partition with an interval in the second transport direction, and the feed chamber and the stirring chamber are arranged non-horizontally with respect to each other.

4. The developing device of claim 1, wherein the second transport member includes a shaft and a paddle, the paddle protruding perpendicularly from a section of the shaft that is adjacent to the second communication passage, and configured to transport the developer, which has been transported through the second transport passage, to the first transport passage via the second communication passage.

5. The developing device of claim 4, wherein a width of the paddle in the second transport direction is substantially equal to a width of the second communication passage in the second transport direction.

6. The developing device of claim 1, wherein the second transport member is divided in the middle of the second transport passage into the section within the upstream section of the second transport passage and the section within the downstream section of the second transport passage.

7. The developing device of claim 1, wherein the first transport member and the second transport member are transport screws each having a shaft and a spiral blade with the same pitch, a rotation speed of the second transport member is higher than a rotation speed of the first transport member, the second transport member further has paddles that are disposed along the shaft thereof at intervals, protrude perpendicularly from the shaft, and are configured to restrict transportation of the developer in the second transport direction, and heights of the paddles are greater in the upstream section than in the downstream section.

8. The developing device of claim 7, wherein the rotation speed of the second transport member is within a range from 1.1 to 1.3 times the rotation speed of the first transport member.

9. The developing device of claim 1, wherein the first transport member and the second transport member are transport screws each having a spiral blade, and $P1<P2<P3$, where P1 denotes a pitch of the spiral blade of the first transport member, P2 denotes a pitch of the spiral blade of the second transport member in the upstream section, and P3 denotes a pitch of the spiral blade of the second transport member in the downstream section.

10. The developing device of claim 9, wherein a rotation speed of the first transport member is the same as a rotation speed of the second transport member.

11. An image forming apparatus having the developing device defined in claim 1.

* * * * *